US008407957B2

(12) United States Patent
McClure

(10) Patent No.: US 8,407,957 B2
(45) Date of Patent: Apr. 2, 2013

(54) WALL INSULATION SYSTEM WITH BLOCKS HAVING ANGLED SIDES

(75) Inventor: Richard R. McClure, Basehor, KS (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 13/418,309

(22) Filed: Mar. 12, 2012

(65) Prior Publication Data

US 2012/0227342 A1 Sep. 13, 2012

Related U.S. Application Data

(63) Continuation of application No. 13/416,959, filed on Mar. 9, 2012, now abandoned.

(60) Provisional application No. 61/451,056, filed on Mar. 9, 2011.

(51) Int. Cl.
*E04B 1/74* (2006.01)

(52) U.S. Cl. ..... 52/404.1; 52/742.1

(58) Field of Classification Search ..... 52/407.2, 52/407.3, 407.4, 512, 404.1, 478, 483.1, 52/742.1, 742.12

See application file for complete search history.

(56) References Cited

U.S. PATENT DOCUMENTS

| | | | | | |
|---|---|---|---|---|---|
| 429,937 | A | * | 6/1890 | Mitchell | 428/594 |
| 2,696,281 | A | | 12/1954 | Hedgren et al. | |
| 2,799,232 | A | | 7/1957 | Jaeger | |
| 2,853,330 | A | * | 9/1958 | Harry | 277/649 |
| 2,910,151 | A | | 10/1959 | Millstine | |
| 2,918,993 | A | | 12/1959 | Coffman et al. | |
| 3,474,583 | A | * | 10/1969 | Theodore | 52/302.7 |
| 3,482,367 | A | | 12/1969 | Curran | |
| 3,555,758 | A | * | 1/1971 | Schroter | 52/309.9 |
| 3,861,326 | A | * | 1/1975 | Brown | 108/57.29 |
| 4,058,949 | A | | 11/1977 | Bellem | |
| 4,516,371 | A | | 5/1985 | Simpson | |
| 4,566,239 | A | * | 1/1986 | Smigel et al. | 52/407.4 |
| 4,571,909 | A | * | 2/1986 | Berghuis et al. | 52/309.8 |
| 5,020,293 | A | * | 6/1991 | Itagaki | 52/314 |
| 5,561,959 | A | * | 10/1996 | Alderman et al. | 52/407.3 |
| 5,724,780 | A | * | 3/1998 | Bolich | 52/407.4 |
| 2003/0167718 | A1 | * | 9/2003 | Alderman | 52/407.3 |
| 2005/0011154 | A1 | * | 1/2005 | Kim | 52/506.06 |

* cited by examiner

*Primary Examiner* — Christine T Cajilig
(74) *Attorney, Agent, or Firm* — Lathrop & Gage LLP

(57) ABSTRACT

Wall systems and methods for making such wall systems are disclosed herein. According to one embodiment, a wall system comprises a plurality of vertically displaced horizontal support members, and a wall panel having at least one inwardly-extending ridge. The wall system also includes at least two foam insulation blocks. Each block has a surface that is adapted to conform to the shape of the inwardly-extending ridge of the wall panel. The blocks are spaced apart along each of the horizontal support members and are fastened between the panel and the support member. The spacing created by the blocks allows for a blanket of insulation between the blocks and the support members to expand, improving the system's insulative properties.

7 Claims, 5 Drawing Sheets

114
116
120
112
122
118
128
110
116
114

122
120
127
126
118
124
114
127
118

114
120
122
120
130
110

WALL INSULATION SYSTEM WITH BLOCKS HAVING ANGLED SIDES

CROSS-REFERENCE TO RELATED APPLICATIONS

This application is a continuation of U.S. patent application Ser. No. 13/416,959, filed Mar. 9, 2012 now abandoned, which claims priority to U.S. Provisional Application No. 61/451,056 filed Mar. 9, 2011, the disclosures of which are herein incorporated by reference.

BACKGROUND OF THE INVENTION

1. Field of the Invention

The invention relates generally to the field of constructing buildings. More specifically, the invention relates to the field of insulating metal buildings.

2. Description of the Related Art

Conventionally, metal buildings are constructed according to a series of steps. First, a metal frame is constructed. The metal frame includes numerous structural support members. The roof portions include sloped roof structural members referred to as purlins. The walls include vertically spaced horizontally extending members, which are referred to as girts. Once the frame is installed, it is common to insulate both the roof and wall portions of the building.

With respect to roof arrangements, blanket insulation is draped over the tops of the purlins, and then roof panels are fastened over the insulation. In some cases, it has been known to install a longitudinal thermal block above the top flange of the purlin such that it runs the entire length of the purlin over the draped blanket insulation.

With respect to the conventional wall, blanket insulation is secured from above such that it is draped over horizontally extending girts. Then metal wall panels are fastened to the outer flanges of the girts, mashing the blanket insulation between the wall panel and the outer flange of each girt where they interface. These lines of packed-down insulation create heat losses.

SUMMARY

The disclosed embodiments include a wall system that is adapted to be installed onto vertically displaced horizontal support members (e.g., girts) on a building. In one embodiment, the system comprises a wall panel having at least one inwardly-extending feature (e.g., a ridge or channel). In embodiments, a number of foam insulation blocks are adapted (on one side) to conform to the shape of the inwardly-extending feature. Further, the blocks can be spaced apart (vertically) along each of the horizontal support members, and then fastened between the wall panel and the support members. The blocks are also spaced apart horizontally which creates an array. The thickness of the blocks creates a gap. The gap allows a blanket of insulation to be expanded into space created between the blocks.

In one embodiment, each of the blocks in the plurality has forwardly angled opposing sides which conform to a reciprocal shape of the feature (e.g., a ridge) and a backside that is adapted to be fixed to an outer flange on each girt.

A method is also disclosed which involves (i) providing a building structure having a plurality of vertically displaced horizontal support members; (ii) obtaining a wall panel having at least one inwardly-extending feature on an inside surface of the wall; (iii) conforming the shape of one side of each of a plurality of insulating blocks to the inwardly extending feature; (iv) placing the plurality of foam insulation blocks between an outside of the horizontal support members and the inwardly-extending feature; and (v) fastening the wall to the horizontal support members, thus sandwiching the blocks.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Embodiments of the present invention provide an insulated metal panel system for a building, and a method for constructing a metal panel for the wall of a building.

Figure 1A:
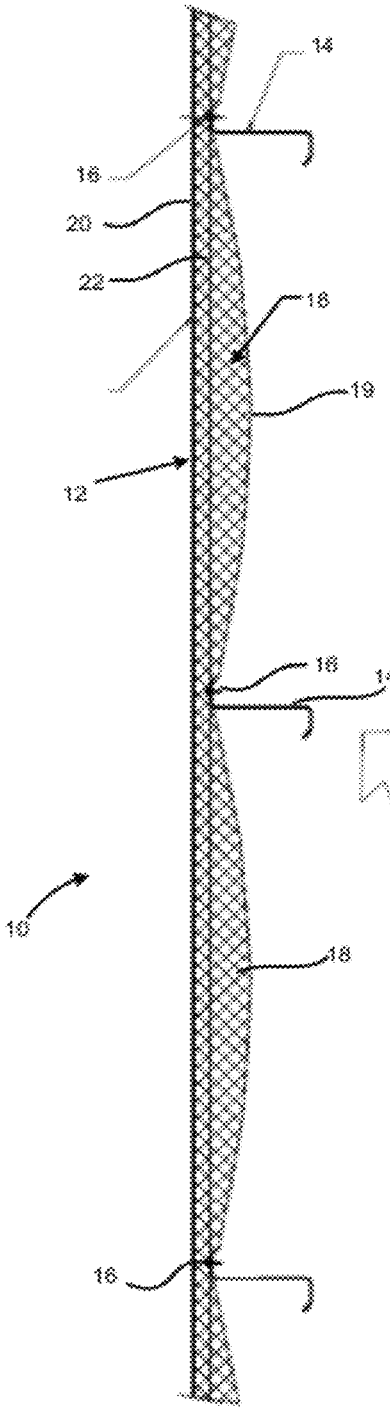
FIG. 1A Prior Art
FIG. 1A shows a cross-sectional wall section of a conventional insulated wall panel.
Figure 1B:
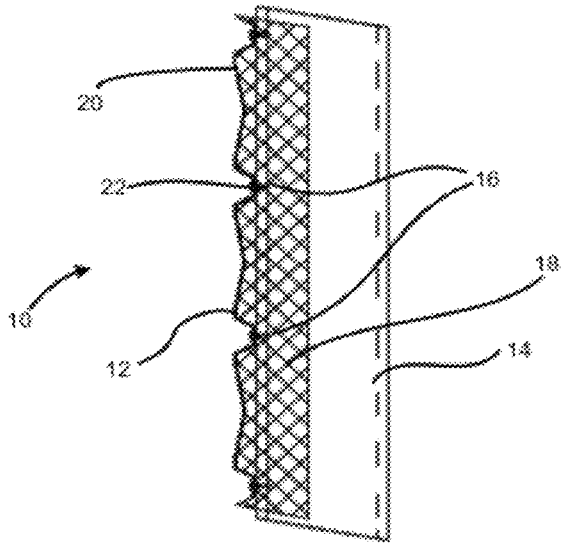
FIG. 1B Prior Art
FIG. 1B shows a top view of a horizontal section taken from a conventional insulated metal building wall design.
Figure 1C:
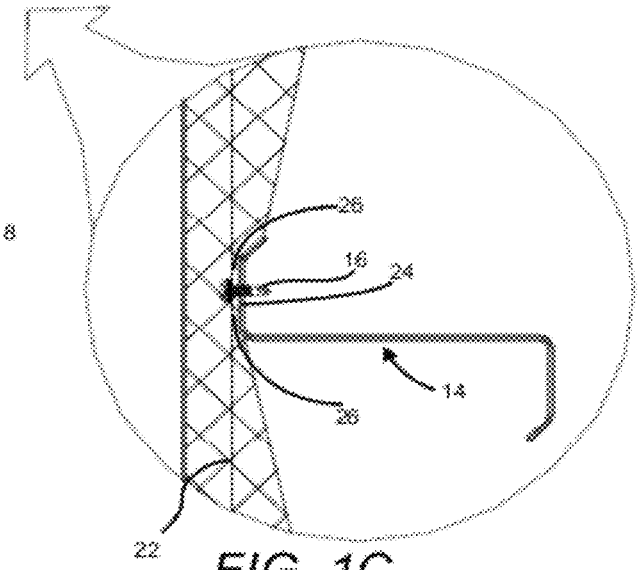
FIG. 1C Prior Art
FIG. 1C is a broken out section showing the specifics around a girt for the conventional design shown in FIGS. 1A and 1B.
Figure 1D:
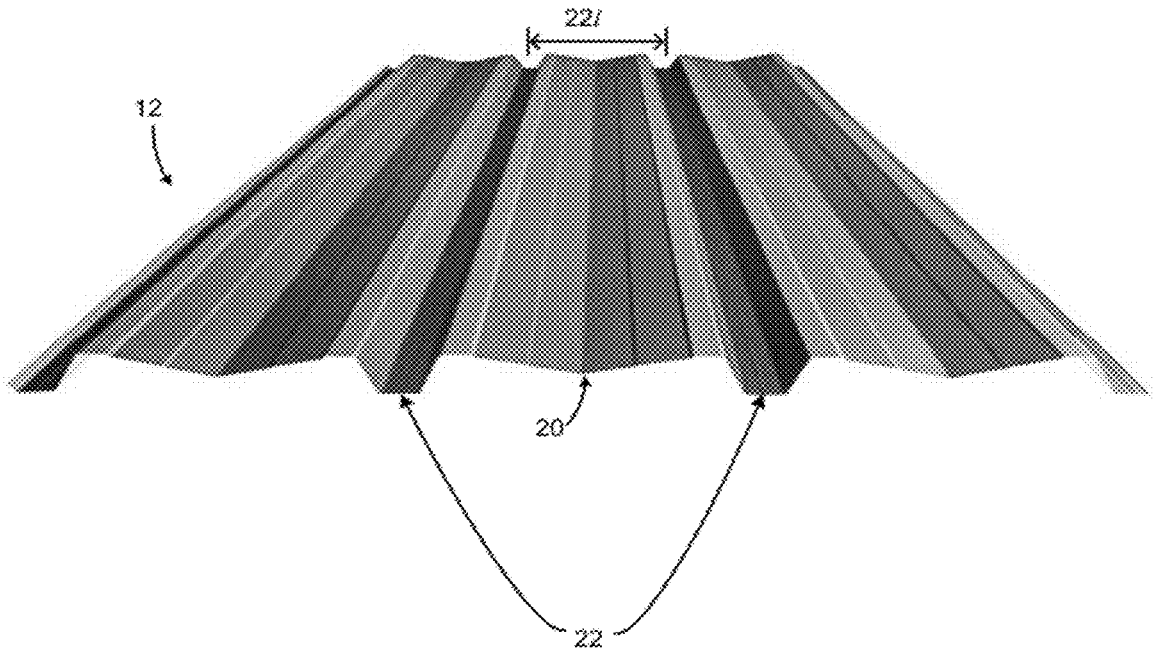
FIG. 1D. PRIOR ART
FIG. 1D shows a conventional wall which could be used to accomplish the objectives of the disclosed embodiments.

In order to provide a context for the disclosed embodiments, prior art drawings FIG. 1A, FIG. 1B, and FIG. 1C show that which is known in the prior art. Referring first to FIG. 1A, a conventional system 10 is shown in which a metal wall panel 12 is installed to create a building wall. This sort of wall panel 12 is normally fastened to a plurality of horizontally running and vertically spaced Z-girts 14. The metal wall panel 12 is typically fastened to the horizontal Z-girt using fasteners 16, which are typically self-tapping screws.

When insulation is desired, a blanket of insulation 18 having a facing 19 on the inside is typically unrolled, draped down the wall, and then secured between the wall panel 12 and the Z-girts 14 using fasteners 16. The fasteners 16 are screwed into the outer flange 24 of the girt, as shown in FIG. 1C. The facing 19 prevents undesirable contact with inhabitants, presents a more appealing look, and creates a vapor barrier. When installed, the insulation is pinched between the inside surface of the vertical channels 22. The vertical channels 22, which run up and down the wall 12, are the innermost part, meaning that they extend towards the building interior the furthest (See FIG. 1B). Between each of these channels, an outermost raised portion 20 of the wall 12 also extends uniformly in a vertical direction. It is through the channel area 22 of the wall 12 that the fasteners 16 are driven, then through the insulation blanket 18, then into the girt outer flange 24.

Looking at the exploded view in FIG. 1C, it can be seen that when the fastener 16 is screwed through the inner portion 22 of the wall it presses against the outermost flange 24 of the girt 14 sandwiching a portion 26 of the insulation.

The compacting of insulation 18 in area 26 causes significant heat losses. As those skilled in the art will recognize, the mashing down of blanket creates an area where the thermal resistance is weakened. Because of this, if one were to look at heat flow diagrams in the areas near the outer flange of the girt, they would see significant flow of heat energy through the area surrounding the fastener 16, with the heat losses being reduced at the locations spaced above or below the girt outer flanges. This is because the insulation 18 (e.g., half way between the girts in FIG. 1A) billows and fluffs outward the further it is from the sandwiching girt outer flanges 24. And considering that the insulation blanket is pinned between the inside surface of the channel 22 and the girt outer flange 24 at numerous locations in the panel 112, the heat loss resulting would appear as a plurality of vertically displaced parallel horizontal stripes of heat loss on the outside of each so-configured wall of the building.

Figure 2:
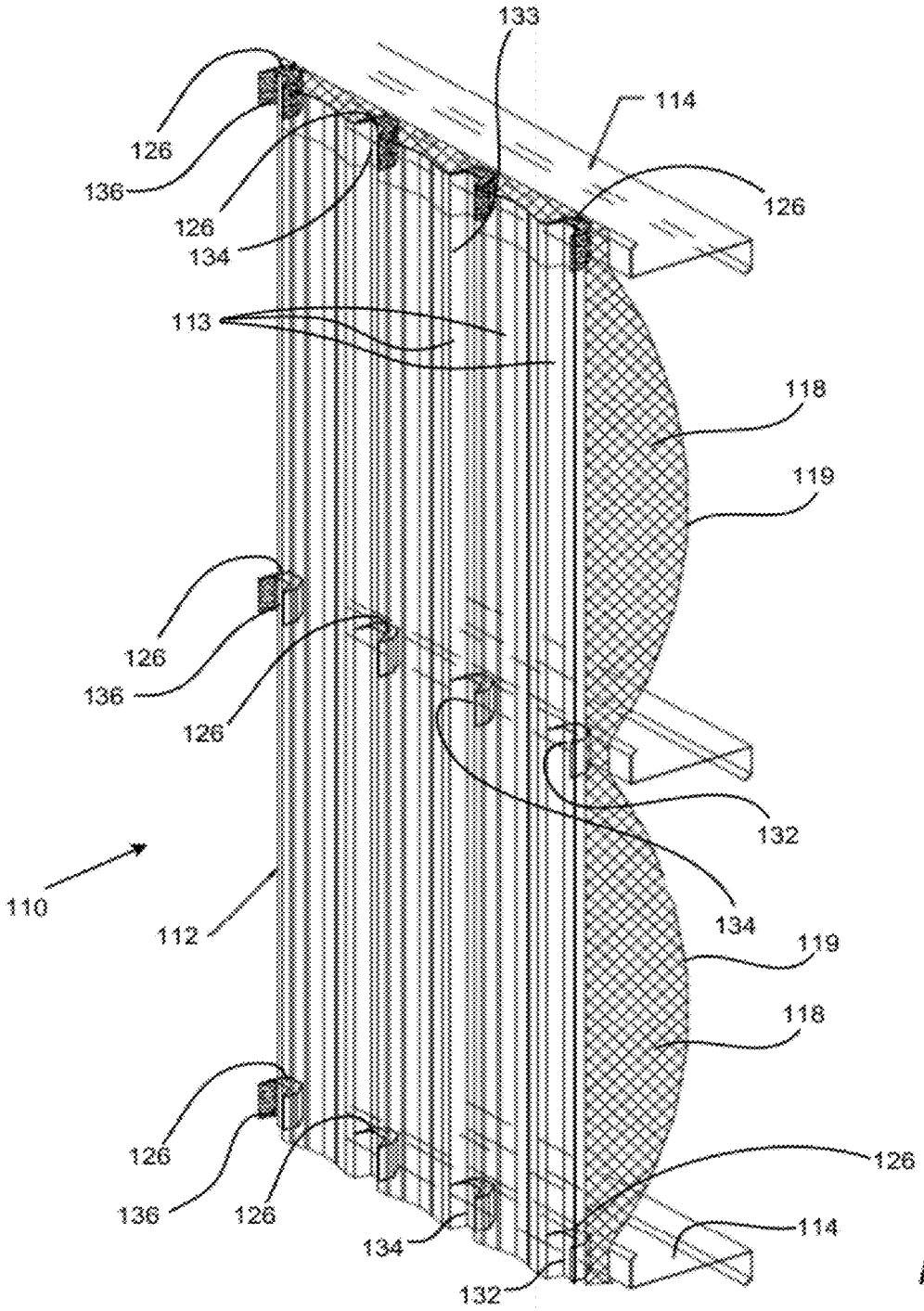
FIG. 2 shows a perspective view of an insulated wall according to the invention disclosed herein.

The arrangement of the present invention 110 which can be seen in FIGS. 2 through 4 greatly reduces the heat losses in the metal wall 112. As with the conventional system, the metal wall 112 is attached outside of the girts 114 of the building using fasteners 116. Also like with the conventional systems a blanket of faced insulation 118 is draped down, and installed between the wall and the girt 114 when the wall is mounted. Also like with the conventional systems, the insulation blanket has a facing 119 on the inside of the insulation. Further, the new system 110, like conventional system 10, is fastened at the innermost channel portions 122 of the wall 112.

But the new system 110 is different in that the outer flanges of the girt 124, upon fastening of the wall panel 112, are not directly pressed against the blanket insulation 118. Instead, a plurality of foam spacer blocks 126, each having forwardly angled opposing sides, are intermittently fastened between the wall 112 and girt outer flange 124 along the length of the girt 14.

Figures 4A, 4B, 4C, 4D:
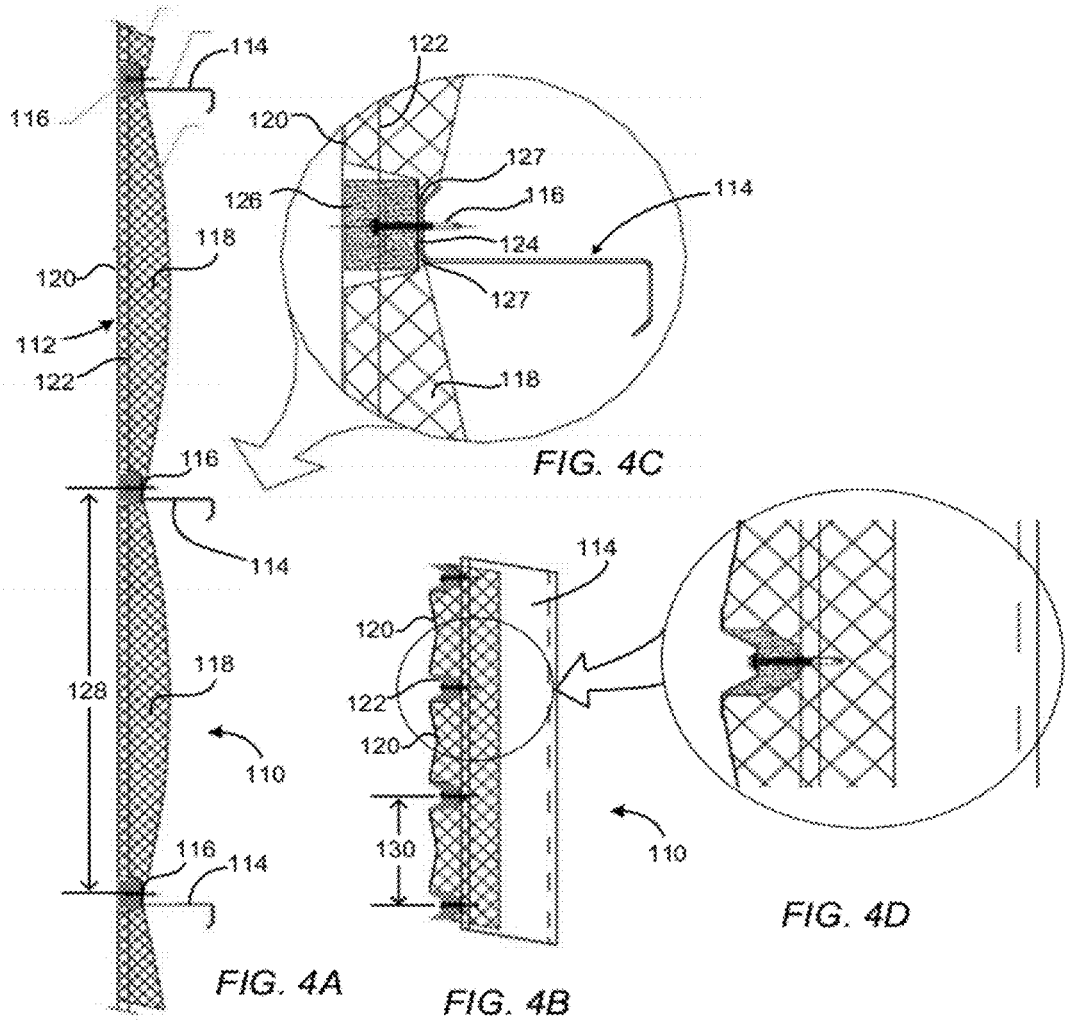
FIG. 4A shows a vertical section taken from the insulated wall of the present invention.
FIG. 4B shows a horizontal section taken of the insulated wall of the present invention.
FIG. 4C shows a broken out section taken from the vertical section of FIG. 4A.
FIG. 4D shows a broken out section taken from the horizontal section taken from FIG. 4B.

As can be seen in FIG. 4A, spacer blocks 126 are spaced vertically by a considerable distance 128. Distance 128 is far greater than the lengthwise dimension of each block allowing for significant vertical spacing between blocks. Also, laterally, the spacer blocks 126 (as can be seen in FIG. 4B) are laterally spaced a distance 130. This creates significant thermodynamic advantages in that the spacer blocks 126, since they are constructed of insulating foam, thermodynamically isolate and displace the metal wall panel 112 from the girt. The lateral dimension of each block is significantly less than the horizontal distance 130 between the blocks, this distance 130 being dictated by the distance between the ridges/channels 122 on the wall panel 112. See FIG. 2. Further, the blanket insulation 118 is only pinched against the girt outer flanges 124 in a few spread-apart locations. Thus, the blocks 126, in addition to providing thermal resistance, also serve to space the wall apart from the girt outer flange. This creates more area for the blanket insulation to billow out (fluff) into, and also prevents the heat loss from extending nearly the full distance of the girt outer flange, as happens in the conventional designs like that shown in FIGS. 1A-C.

Figure 3A:
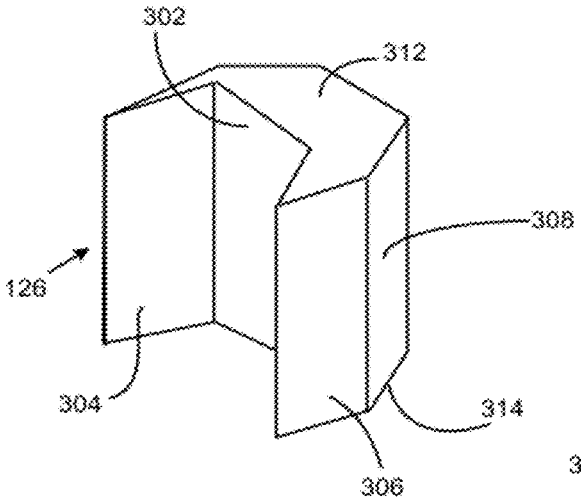
FIGS. 3A, 3B, 3C, and 3D show an angle-edged spacer block from perspective, above, and in front, respectively.
Figure 3B:
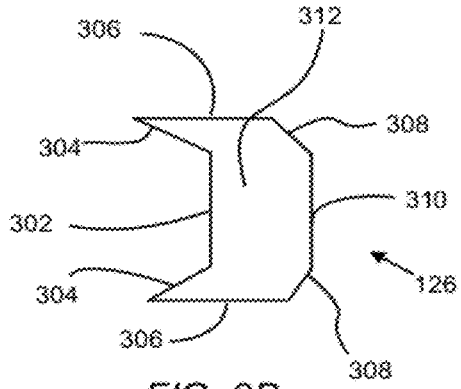
Figure 3C:
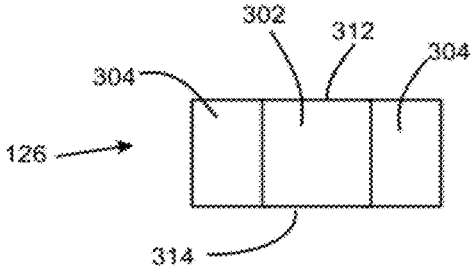
Figure 3D:
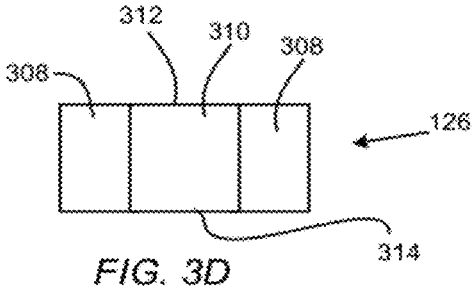

Details of the spacer block 126 can best be seen in FIGS. 3A-D. Referring first to FIG. 3A, it can be seen that each spacer block 126 has a front face 302 (see FIG. 3C) and two opposing angled front faces 304. Laterally, spacer block 126 has sides 306 which extend back to two rear portions 308 which are created by truncating the back portions of the block at converging angles, and then a rear face 310. FIG. 3D shows the back of the block 126. A top 312 of the block 126 can be seen in FIG. 3B and is pointed to in both of FIGS. 3C and 3D. Although it is not shown, the bottom of block 126 is the same as the top 312, and the block 126 is symmetrical from side to side, and top to bottom.

As can best be seen in FIGS. 2 and 4C-D, these blocks 126 are specially configured to fit inside between the inside ridge surfaces of the channel/ridge portions 122 of the wall and the girt outer flange 124. More specifically, face 302 will butt against the ridge of the channel 122, and the angled sides 304 will correspond to the sloped surfaces of the channel 122 so that the block fit inside the wall is true. On the other side of the block 126, the back 310 will butt against the girt outer flange 124 when the wall is fastened.

Each of the blocks 126 has a thickness dimension (between faces 302 and 310). Because of this, the placement of the blocks (in the array shown in FIG. 2) results in a gap between innermost portions of the wall (e.g., the ridges) and the outer flanges 124 of the horizontal support members 114. This enables the expansion of the blanket of insulation into the gap created.

In terms of assembly in the erection of the building, the girts 114 will already be in place as shown in the figures, and the remaining wall components will be installed outside them. In some embodiments, the blanket insulation 118 will be draped over the outsides of the girts 114. It is not necessary to independently fasten the insulation 118 at this point, but in may instances it will make sense to secure the blanket 118 from above and allow it to drape down before fastening the wall onto the girts 114. The next step, in embodiments, involves the securement of the blocks in some way. In some embodiments, this would mean that the blocks would be adhered or in some other way fastened to the inside surfaces (ridges) of the wall in the positions shown before the wall is fastened in place. The precise position for adhering each block 126 will be determined by spacing the horizontal rows of blocks 126 at the vertical positions of each horizontally extending girt (see FIG. 2). This enables the user with all of the blocks 126 adhered, to place the panel 112 over the draped insulation 118 and hold the panel 112 in place. Then, each fastener 116 (e.g., self-tapping screw) can be screwed through the panel 112 outside of where each block 126 exists, through the block, and bite into the girt outer flange 124. Once all of the fasteners 116 have been installed, the panel/block assembly will be secured to the building, but significant open space will be created by the distance between the panel 112 and the girt 114. The blocks 126 create this space. This space created not only allows for more fluffing of the insulation 118 between the girts 114, but also allows for the fluffing into the spaces created between the blocks along the girt flange.

Fluffed blanket insulation is considerably more effective as a heat barrier than insulation that is matted down. Thus, a much higher percentage of the wall panel 112 is backed by insulation which is billowed rather than matted down. Therefore, as opposed to the conventional system shown in FIG. 1, heat losses are greatly reduced by use of the blocks. Also, in the FIGS. 2-4 embodiments where there is no fluffed insulation behind the wall, the foam insulation blocks 126 exist. Thus, a high level of heat resistance is provided across the whole panel after it is installed, unlike the conventional systems.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A wall system comprising:

a plurality of vertically displaced horizontal support members; a wall panel having at least one inwardly-extending ridge on an inside surface of the wall panel; and a plurality of foam insulation blocks, each of the blocks being substantially solid and having surfaces adapted to conform to tile shape of the inwardly-extending ridge;

wherein the plurality of foam insulation blocks are spaced apart along each of the horizontal support members, the blocks being fastened between the panel and the support members;

a blanket of insulation expanded between the support members and the blocks into a space laterally between the blocks, and wherein the blocks are vertically spaced from one another by a distance that is greater than a length of one individual block.

2. The wall system of claim 1 wherein each of the blocks in the plurality has forwardly angled opposing sides which conform to a reciprocal shape of the ridge.

3. The wall system of claim 1 wherein the blocks are horizontally spaced from one another by a distance that is greater than a width of one individual block.

4. The wall system of claim 1 wherein the horizontal support members are girts, and the blocks are fastened into an outer flange of each girt.

5. The wall system of claim 1 wherein:

each of the blocks has a thickness dimension; and the placement of the blocks results in a gap between innermost portions of the wall panel and a plurality of outer flanges on the horizontal support members to enable the expansion of the blanket of insulation into the gap.

6. The wall system of claim 1 wherein each of the foam insulation blocks comprises:

a front face;

two opposing angled lateral faces adapted to conform to the shape of the ridge on the wall panel; and a substantially flat rear face for engaging an outer flange of the horizontal support member.

7. A method of making a wall comprising:

providing a building structure having a plurality of vertically displaced horizontal support members;

obtaining a wall panel having at least one inwardly-extending feature on an inside surface of the wall;

conforming the shape of one side of each of a plurality of foam insulating blocks to the inwardly extending feature;

placing the plurality of foam insulation blocks between an outside of the horizontal support members and the inwardly-extending feature, wherein the blocks are vertically spaced from one another by a distance that is greater than a length of one individual block;

and fastening the wall to the horizontal support members, thus sandwiching the blocks.

* * * * *

UNITED STATES PATENT AND TRADEMARK OFFICE

CERTIFICATE OF CORRECTION

PATENT NO. : 8,407,957 B2
APPLICATION NO. : 13/418309
DATED : April 2, 2013
INVENTOR(S) : Richard R. McClure It is certified that error appears in the above-identified patent and that said Letters Patent is hereby corrected as shown below:

In the Claims

Column 5, Line 17, Claim 1, “tile shape” should read --the shape--

Signed and Sealed this
Twenty-first Day of October, 2014

Michelle K. Lee

Michelle K. Lee
*Deputy Director of the United States Patent and Trademark Office*